US007548706B2

(12) United States Patent
Yamamoto

(10) Patent No.: US 7,548,706 B2
(45) Date of Patent: Jun. 16, 2009

(54) IMAGE FORMING APPARATUS AND IMAGE FORMING METHOD FOR ADJUSTING HEAT APPLIED DURING THE FIXING STAGE

(75) Inventor: Yoshikazu Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 170 days.

(21) Appl. No.: 11/640,327

(22) Filed: Dec. 18, 2006

(65) Prior Publication Data

US 2008/0003005 A1 Jan. 3, 2008

(30) Foreign Application Priority Data

Jul. 3, 2006 (JP) ..... 2006-183671

(51) Int. Cl.
*G03G 15/20* (2006.01)

(52) U.S. Cl. ..... 399/67; 399/336; 399/337

(58) Field of Classification Search ..... 399/67, 399/336, 337

See application file for complete search history.

(56) References Cited

FOREIGN PATENT DOCUMENTS

JP A 5-119666 5/1993

JP A 2004-170801 6/2004

OTHER PUBLICATIONS

Machine translation of JP 2004-170801, cited in Applicant's Information Disclosure Statement dated Dec. 18, 2006.*

* cited by examiner

*Primary Examiner*—David M Gray
*Assistant Examiner*—Bryan Ready
(74) *Attorney, Agent, or Firm*—Oliff & Berridge, PLC

(57) ABSTRACT

An image forming apparatus that performs fixing processing on a sheet having a transferred toner image in smaller area units than the size of the sheet includes an image forming unit that forms a toner image in each predetermined color, a transfer unit that transfers the toner image in each color over a sheet, a detecting unit that detects, for each of the areas, the maximum number of stacked toner images, a determining unit that determines the amount of heat to be applied to the area based on the maximum number of stacked toner images of the area detected by the detecting unit, and a fixing unit that, on each of the areas on the sheet after the transfer processing by the transfer unit, applies the amount of heat determined by the determining unit and fixes a transferred toner image in each color.

8 Claims, 5 Drawing Sheets

IMAGE FORMING APPARATUS AND IMAGE FORMING METHOD FOR ADJUSTING HEAT APPLIED DURING THE FIXING STAGE

BACKGROUND (1) Technical Field

The present invention relates to an image forming apparatus and an image forming method for an electronic photograph scheme.

(2) Related Art

It is known that an image forming apparatus that performs fixing processing on a sheet on which a toner image is transferred in smaller area units than the size of the sheet.

SUMMARY

According to an aspect of the invention, there is provided an image forming apparatus that performs fixing processing on a sheet having a transferred toner image in smaller area units than the size of the sheet, the apparatus including; an input unit that inputs color image data; an image forming unit that performs color separation on color image data input by the input unit and forms a toner image in each predetermined color; a transfer unit that transfers the toner image in each color formed by the image forming unit over a sheet; a detecting unit that detects, for each of the areas, the maximum number of stacked toner images transferred within the area of the sheet having a transferred toner image in each color by the transfer unit; a determining unit that determines, for each of the areas, the amount of heat to be applied to the applicable area based on the maximum number of stacked toner images of the area detected by the detecting unit; and a fixing unit that, on each of the areas on the sheet after the transfer processing by the transfer unit, applies the amount of heat determined by the determining unit as the amount of heat to be applied to the area and fixes a transferred toner image in each color.

BRIEF DESCRIPTION OF THE DRAWINGS

Exemplary embodiments of the invention will be described in detail based on the following figures, wherein.

DETAILED DESCRIPTION

With reference to drawings, an exemplary embodiment of the invention will be described below.

Figure 1:
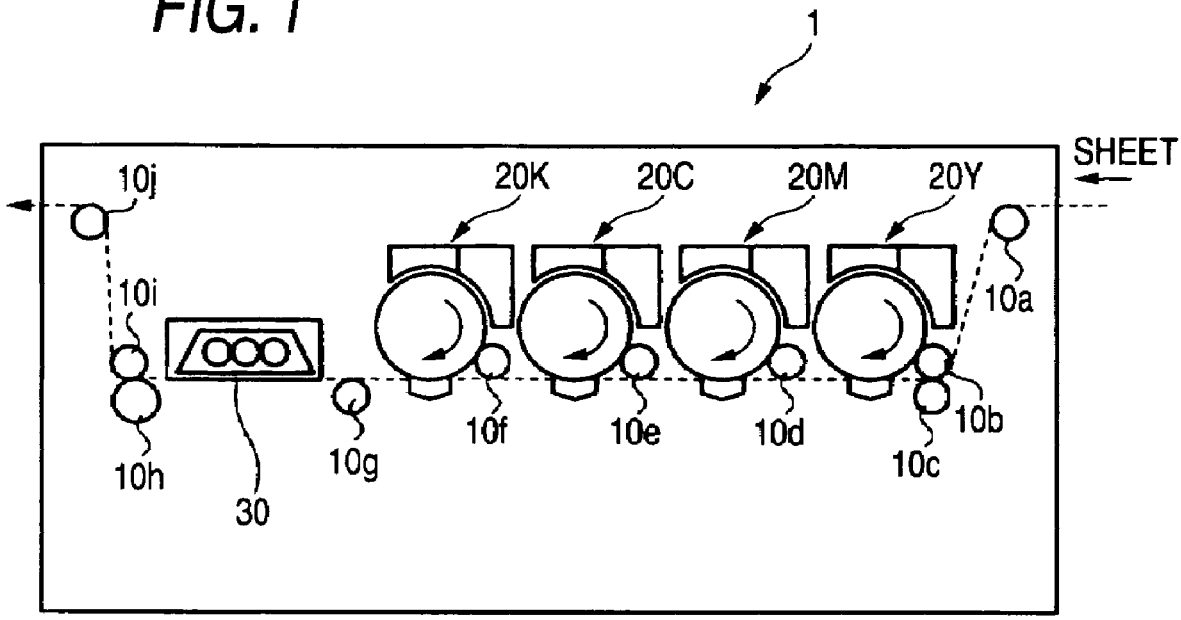
FIG. 1 is a diagram showing a color printing apparatus 1 according to an exemplary embodiment.

FIG. 1 is a diagram showing a color printing apparatus 1 according to an exemplary embodiment.

As shown in FIG. 1, the sheet fed from a paper-feeding device is transported by multiple transportation rollers 10*a*, 10*b*, . . . , 10*i* and 10*j* within the color printing apparatus 1 along a transportation path indicated by the shown broken line. Image forming units 20Y, 20M, 20C and 20K for colors of Y, M, C and K transfer toner images on the transported sheet. For example, the toner image in Y (yellow) is transferred on the sheet by the image forming unit 20Y, and the toner image in M (magenta) is transferred to the sheet by the image forming unit 20M. The toner images in colors of Y, M, C and K are multi-layer-transferred on the sheet by the image forming units 20Y, 20M, 20C and 20K.

A fixing unit 30 heats the sheet having the multi-layer-transferred toner images in the colors and fixes the transferred toner images in the colors on the sheet. The fixing unit 30 performs fixing processing in predetermined area units, the size of which is sufficiently smaller than the size of one sheet, which will be described in detail later. In other words, the fixing unit 30 can perform heating processing on the sheet having the multi-layer transferred toner images in the colors by changing the amount of heat to be applied to each of the area units.

The color printing apparatus 1 includes an input section, a color separating section, a memory and a controller, not shown in FIG. 1. The input section is used for inputting color image data. The color separating section color-separates input color image data and outputs image data in colors of Y, M, C and K obtained by the color separation to the corresponding image forming units 20Y, 20M, 20C and 20K. The memory stores a program and data. The controller executes a program stored in the memory and controls the components of the color printing apparatus 1. The input section according to this exemplary embodiment communicates with an external host apparatus and receives color image data from the host apparatus.

Figure 2:
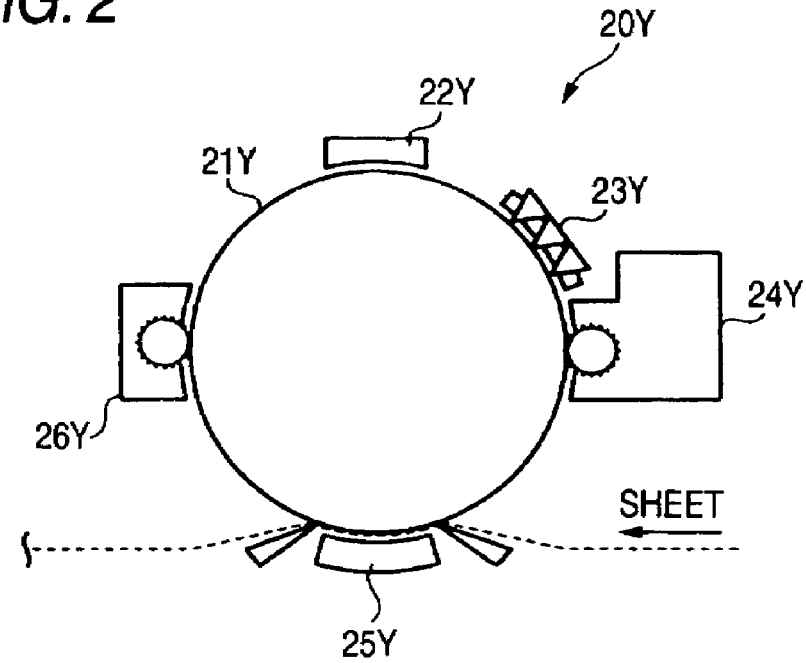
FIG. 2 is a diagram showing an image forming unit 20Y.

FIG. 2 shows the image forming unit 20Y.

Since the hardware constructions of the image forming units 20Y, 20M, 20C and 20K are identical, the construction of the image forming unit 20Y will be only described here.

As shown in FIG. 2, a charging device 22Y, a light-exposing device 23Y, a developing device 24Y, a transfer device 25Y and a cleaner 26Y are provided around a photoconductive drum 21Y. The charging device 22Y charges the surface of the photoconductive drum 21Y to a predetermined potential. The light-exposing device 23Y forms an electrostatic latent image on the surface of the photoconductive drum 21Y by irradiating a light-exposure beam thereto. The developing device 24Y causes a yellow toner to be adhered to the electrostatic latent image on the surface of the photoconductive drum 21Y. Thus, the yellow toner image is formed on the surface of the photoconductive drum 21Y. The transfer device 25Y has the potential of the opposite polarity of the electrostatic latent image on the surface of the photoconductive drum 21Y, for example. The potential difference between the potential given to the transfer device 25Y and the potential of the electrostatic latent image part functions as a transfer bias, whereby the yellow toner image on the surface of the photoconductive drum 21Y is transferred onto a sheet. The cleaner 26Y removes the toner remained on the surface of the photoconductive drum 21Y.

Having described the construction of the image forming unit 20Y, the image forming units 20M, 20C and 20K having the identical hardware constructions form magenta, cyan and black toner images, respectively, which are then fixed on a transported sheet.

Figure 3:
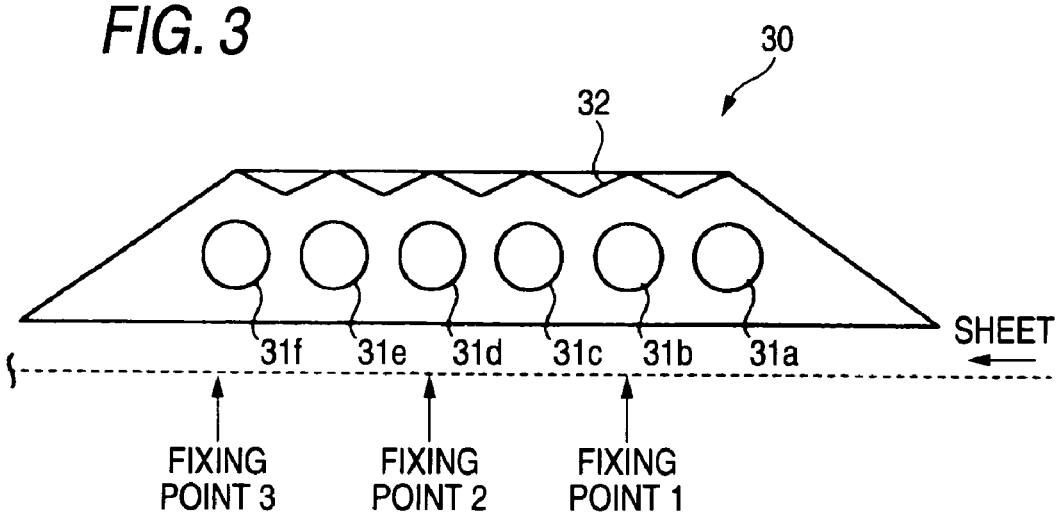
FIG. 3 is a diagram showing a fixing unit 30.

FIG. 3 shows a fixing unit 30.

The fixing unit 30 adopts a flash-fixing process, and includes six xenon lamps 31*a* to 31*f* in the direction of transportation of sheets as shown in FIG. 3. In FIG. 3, a sheet having a multi-layer transferred toner images in Y, M, C and K is transported from the right side to the left side of FIG. 3. A reflector 32 is provided above the xenon lamps 31*a* to 31*f* in order to irradiate the light emitted by the xenon lamps 31*a* to 31*f* to a sheet efficiently and increase the efficiency of heating. The controller of the color printing apparatus 1 controls the switching on and off of the xenon lamps 31*a* to 31*f*, whereby the amount of heat to be applied to a transported sheet is changed in areas defined for the fixing process.

FIG. 3 has Fixing Point 1 at the lower left of the xenon lamp 31*b*, Fixing Point 2 at the lower left of the xenon lamp 31*d* and Fixing Point 3 at the lower left of the xenon lamp 31*f* in FIG. 3 for the operational description below.

Next, an operation of the color printing apparatus 1 will be described.

The input section of the color printing apparatus 1 first receives color image data by communicating with a host apparatus under the control of the controller. The received color image data is color-separated by the color-separating section, and the image data in colors of Y, M, C and K resulting from the color separation are output to the corresponding image forming units 20Y, 20M, 20C and 20K. The image forming units 20Y, 20M, 20C and 20K form and transfer the toner images in colors of Y, M, C and K to a sheet. The controller of the color printing apparatus 1 performs amount-of-heat determining processing, which will be described later, in parallel with the processing up to the multi-layer transfer of the toner images in colors to a sheet after the color image data is received from the host apparatus. The amount-of-heat determining processing is performed as the upstream processing of the fixing processing.

Figure 4:
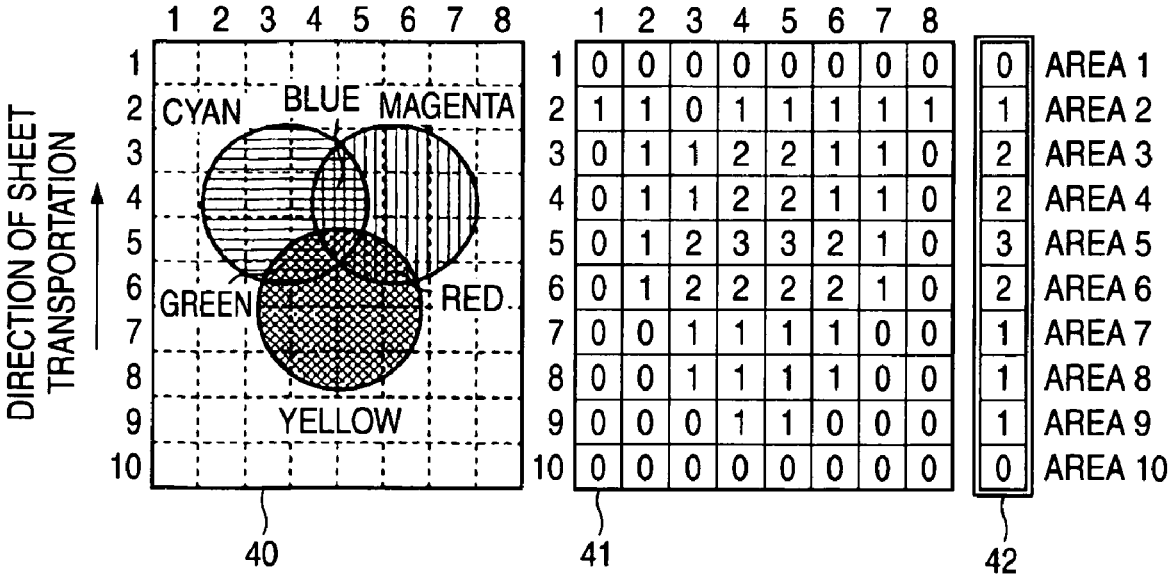
FIG. 4 is a (first) diagram for describing thermal amount determining processing to be performed by the color printing apparatus 1.

FIG. 4 is a diagram for describing the amount-of-heat determining processing to be performed in the color printing apparatus 1. Upon receipt of the color image data from the host apparatus, the controller expands the image data (bitmap data) in colors of Y, M, C and K resulting from the color separation on the color image data to a memory as an image datamap 40 shown in FIG. 4. The example of the image datamap 40 shown in FIG. 4 renders the partial superimposition of a circle painted out with cyan, a circle painted out with magenta and a circle painted out with yellow and includes strings, "Cyan", "Magenta", "Yellow", "Blue", "Red", "Green" in black. The part where cyan and magenta are superimposed exhibits blue. The part where magenta and yellow are superimposed exhibits red. The part where yellow and cyan are superimposed exhibits green. The part where cyan, magenta and yellow are superimposed exhibits black.

The entire size of the image datamap 40 is equal to the size of one sheet. In other words, the image datamap 40 is identical to the image (actually transferred image) of the toner images in colors, which is multi-layer transferred on the sheet by the image forming units 20Y, 20M, 20C and 20K without the occurrence of the state out of registration, for example.

The squares enclosed by the broken lines on the image datamap 40 indicate the correspondence with a multi-layer transfer matrix 41, which will be described later. The controller detects the maximum number of stacked toner images within each square on the image datamap 40 expanded to the memory in order from the square at the upper right end. For example, if no toner image in Y, M, C and K exists within a square, the maximum number of stacked toner images is "0". If a toner image in one color of Y, M, C and K only exists within a square, or if two or more toner images in different colors exist but there is not a part where the toner images superimpose, the maximum number of stacked toner images is "1".

If two toner images in different colors exist within a square and there is a part where the toner images are superimposed, or if three toner images in different colors exist within a square, but no part exists where all of the toner images are superimposed, and two toner images superimpose at maximum, the maximum number of stacked toner images is "2". If three toner images in different colors exist within a square, and there is a part where all toner images are superimposed, the maximum number of stacked toner images is "3". If toner images in colors of Y, M, C and K exist within a square, and if there is a part where all of the toner images are superimposed, the maximum number of stacked toner images is "4".

For example, on the image datamap 40 as shown in FIG. 4, the row numbers are defined as "1", "2", "3", . . . , "9" and "10" to the below in FIG. 4 with respect to the square at the upper right end while the column numbers are defined as "1", "2", "3", . . . , "7"and "8" to the right in FIG. 4 with respect to the square at the upper right end. The eight squares with the row number, "1", have no toner images. Thus, the maximum number of stacked toner images of these squares is "0". Since the square with the row number, "2", and the column number, "1", only has a black string, that is, a toner image in black, the maximum number of stacked toner images is "1". Since the square with "4" as the row and column numbers has toner images in cyan and magenta superimposed on each other, the maximum number of stacked toner images is "2". Since the square with the row number, "5", and column number, "4", has all toner images in cyan, magenta and yellow superimposed on each other, the maximum number of stacked toner images is "3".

In this way, the controller detects the maximum number of stacked toner images of each square of the image datamap 40 and stores it in a memory as the multi-layer transfer matrix 41 shown in FIG. 4. The multi-layer transfer matrix 41 is used for determining the amount of heat to be applied to a sheet in fixing processing for each area defined for fixing processing. Now, the area defined for fixing processing will be first described.

As described above, the image datamap 40 shown in FIG. 4 is identical to the image (actually transferred image) of the toner images in colors, which are multi-layer transferred on a sheet by the image forming units 20Y, 20M, 20C and 20K without the occurrence of a state out of registration. Describing the area for fixing processing by using the image datamap 40 shown in FIG. 4, the area for fixing processing according to this exemplary embodiment is each area resulting from the division of the image datamap 40 in FIG. 4 into rows. In other words, since the image datamap 40 has a total of ten rows of squares, a total of ten areas for fixing processing are defined for one sheet in order to print a color image on the image datamap 40. When the same numerical values as the row numbers are handled as area numbers for identifying the areas for fixing processing, the area N (where N=1 to 10) defined for fixing processing is an area including a total of eight squares with the row number, "N".

The controller determines the amount of heat to be applied to the areas 1 to 10 for fixing processing by using the multi-layer transfer matrix 41. More specifically, the controller selects the highest numerical value from the eight maximum number of stacked toner images for each row on the multi-layer transfer matrix 41 shown in FIG. 4 and handles the numerical value as the value of the amount-of-heat level indicating the amount of heat to be applied to the corresponding area. Since the possible value of the maximum number of stacked toner images according to this exemplary embodiment is a value of "0" to "4", the value of the amount of heat is a value of "0" to "4". As the numerical value of the amount-of-heat level increases, the amount of heat to be applied increases.

For example, on the multi-layer matrix 41 shown in FIG. 4, the total of eight squares with the row number, "1", the value of the maximum number of stacked toner images is all "0". Thus, the value of the amount-of-heat level of Area 1 is "0". The maximum value of the maximum numbers of stacked toner images of the total of eight squares with the row number, "2", is "1". Thus, the value of the amount-of-heat level of Area 2 is "1". Similarly, since the maximum value of the maximum number of stacked toner images of the total of eight squares with the row number, "3", is "2", the value of the amount-of-heat level of Area 2 is "2". In this way, the controller selects the highest numerical value from the total of eight maximum numbers of stacked toner images for each row on the multi-layer transfer matrix 41 and stores the numerical value (the value of the amount-of-heat level) in a memory as an amount-of-heat determination table 42 as shown in FIG. 4 in connection with the area number. Then, fixing processing is performed by using the value of the amount-of-heat level stored on the amount-of-heat determination table 42.

Figure 5:
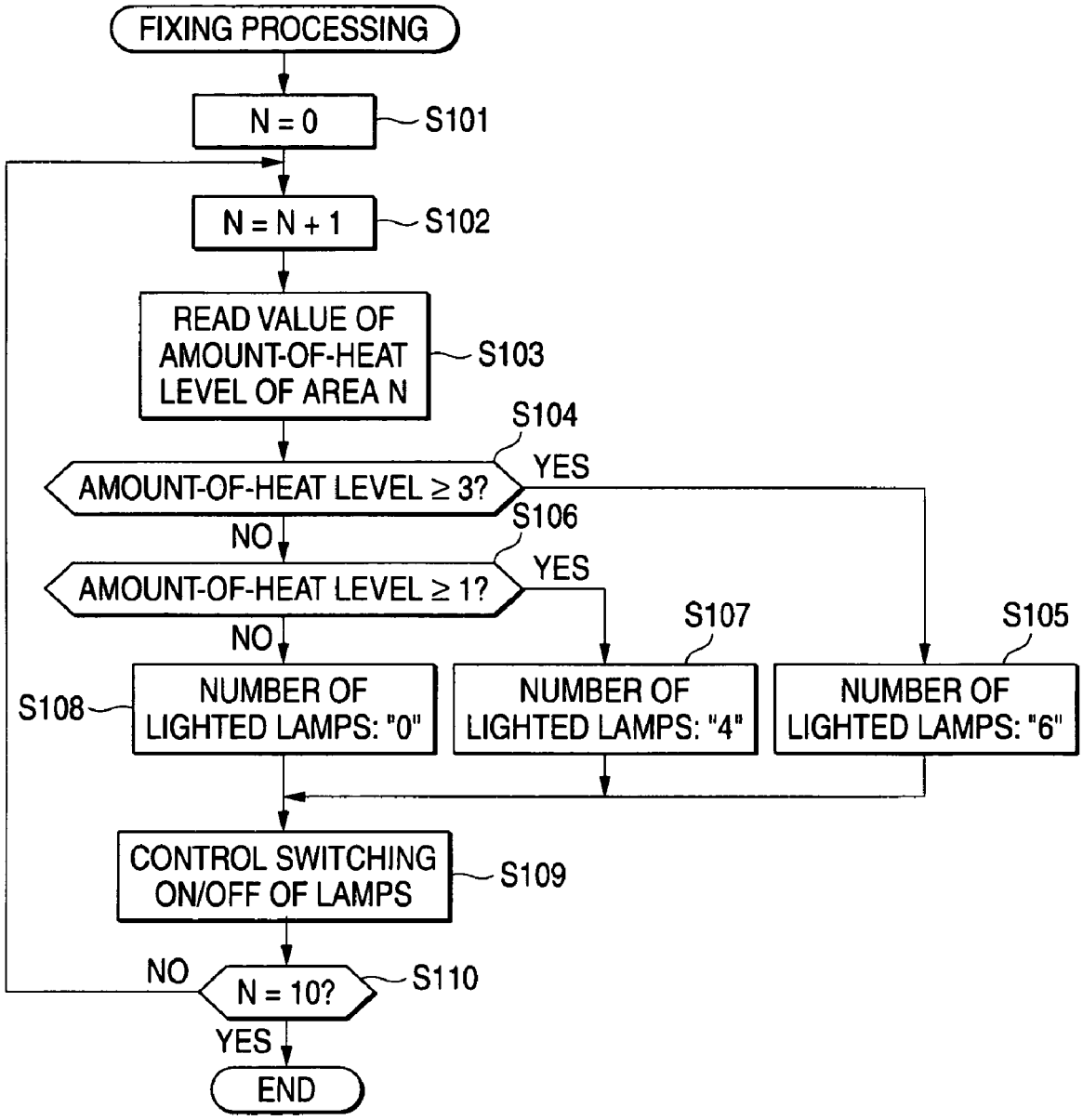
FIG. 5 is a flowchart showing fixing processing to be performed by the color printing apparatus.

FIG. 5 is a flowchart describing fixing processing to be performed by the color printing apparatus 1. As shown in FIG. 5, after the controller resets the value of the area number N to "0" (step S101), the value of the area number N is incremented (step S102). Next, the controller invokes the value of the amount-of-heat level corresponding to the area number N from the amount-of-heat determination table 42 stored in a memory (step S103). For example, if the area number N is "1", and the amount-of-heat determination table 42 shown in FIG. 4 is stored in a memory, "0" is invoked as the value of the amount-of-heat level of area 1 in step S103 above.

Next, the controller determines whether the invoked value of the amount-of-heat level is "3" or higher or not (step S104). As a result, if the value of the amount-of-heat level is "3" or higher, that is, if the invoked value of the amount-of-heat level is "3" or "4", the controller determines to switch on all of the six xenon lamps 31*a* to 31*f* for the area N in the fixing processing by the fixing unit 30 (step S105) Then, processing moves to step S109. For example, on the amount-of-heat determination table 42 shown in FIG. 4, the area having "3" or "4" as the value of the amount-of-heat level is only Area 5. Thus, fixing processing is performed on Area 5 by switching on all of six xenon lamps 31*a* to 31*f*.

If the determination in step S104 above results in "NO", the controller next determines whether the invoked value of the amount-of-heat level is "1" or higher or not (step S106) If the value of the amount-of-heat level is "1" or higher as a result, that is, if the invoked value of the amount-of-heat level is "1" or "2", the controller determines to switch on the four xenon lamps 31*a* to 31*d* (step S107) excluding the xenon lamps 31*e* and 31*f* in the fixing processing by the fixing unit 30 on the area N, and the processing then moves to step S109. For example, the areas having "1" or "2" as the value of the amount-of-heat level are Areas 2 to 4 and Areas 6 to 9 on the amount-of-heat determination table 42 shown in FIG. 4. Thus, fixing processing is performed on the areas by switching on the total of four xenon lamps 31*a* to 31*d*.

If the determination in step S106 results in "NO", that is, if the invoked value of the amount-of-heat level is "0", the controller determines to switch off all of the six xenon lamps 31*a* to 31*f* in the fixing processing by the fixing unit 30 on the area N (step S108). Then, the processing moves to step S109. For example, the areas having "0" as the value of the amount-of-heat level are Areas 1 and 10 on the amount-of-heat determination table 42 shown in FIG. 4. Thus, fixing processing is performed on the two areas by keeping all of the xenon lamps 31*a* to 31*f* off.

Next, the controller in step S109 generates a lamp control signal for controlling the switching on and off of the xenon lamps 31*a* to 31*f* for the area N in accordance with the number of the xenon lamps 31*a* to 31*f* to be switched on, which is determined in step S105, S107 or S108 and supplies the lamp control signal to the fixing unit 30. Then, the controller determines whether the value of the area number N is "10" or not, that is, whether processing has been completely performed on all of the areas defined for fixing processing or not (step S110). If the value of the area number N does not reach "10", the processing returns to step S102 above. On the other hand, if the value of the area number N is "10", the fixing processing ends.

Figure 6A:
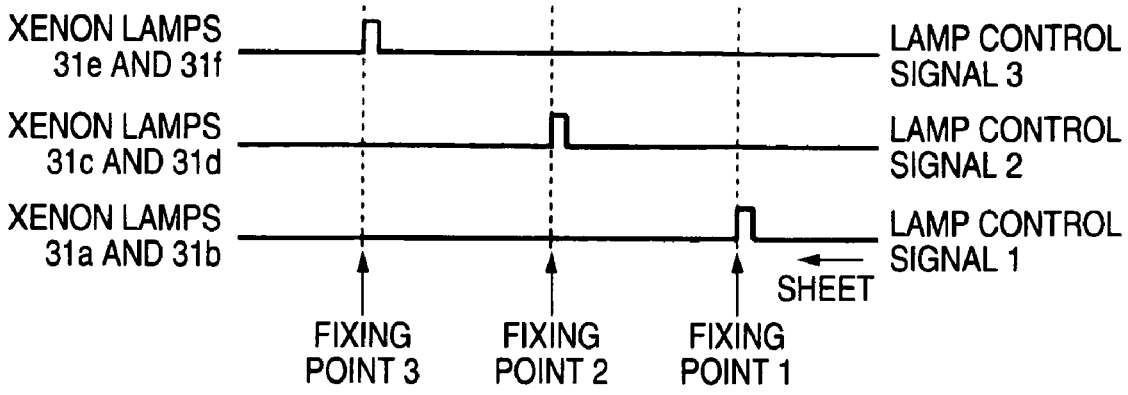
FIGS. 6A and 6B are diagrams for describing timing of switching on and off xenon lamps 31*a* to 31*f;*
Figure 6B:
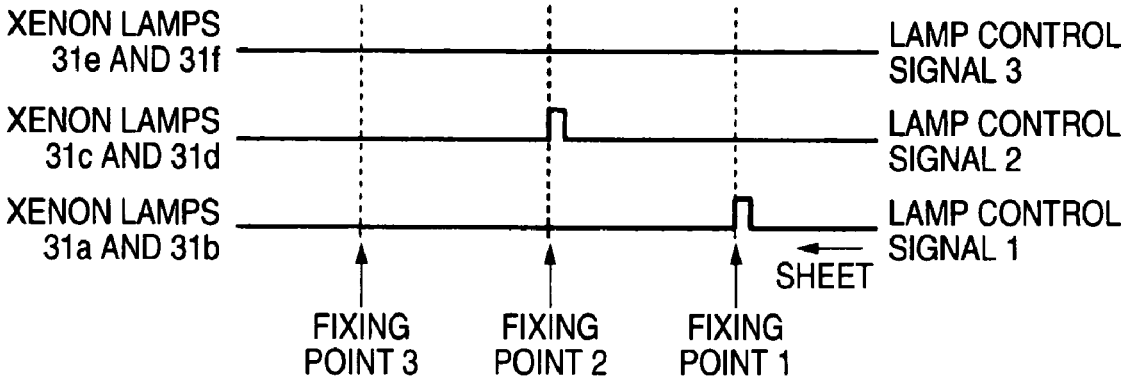

FIGS. 6A and 6B are diagrams for describing timing for the switching on and off of the xenon lamps 31*a* to 31*f*. FIG. 6A illustrates a case that the value of the amount-of-heat level is "3" or "4". FIG. 6B illustrates a case that the value of the amount-of-heat level is "1" or "2". According to this exemplary embodiment, the six xenon lamps 31*a* to 31*f* are divided into three pairs of the xenon lamps 31*a* and 31*b*, xenon lamps 31*c* and 31*d* and xenon lamps 31*e* and 31*f*, and the switching on and off are controlled for each of the pairs. Thus, the lamp control signals are divided into a lamp control signal 1 for controlling the switching on/off of the xenon lamps 31*a* and 31*b*, a lamp control signal 2 for controlling the switching on/off of the xenon lamps 31*c* and 31*d* and a lamp control signal 3 for controlling the switching on/off of the xenon lamps 31*e* and 31*f*. The lamp control signals 1 to 3 shown in FIG. 6 are switched on in a period when the signal values are at High level and are switched off in a period when the signal values are at Low level.

As described above, for the area having "3" or "4" as the value of the amount-of-heat level, all of the six xenon lamps 31*a* to 31*f* are switched on in fixing processing. In other words, on the amount-of-heat determination table 42 shown in FIG. 4, the lamp control signals 1 to 3 having the signal waveforms shown in FIG. 6A are supplied to the fixing unit 30 for Area 5 only. Thus, as shown in FIG. 6A, when the Area 5 part of a sheet reaches Fixing Point 1 through the part below the xenon lamps 31*a* and 31*b*, the xenon lamps 31*a* and 31*b* are switched on. Then, when the Area 5 part reaches Fixing Point 2 through the part below the xenon lamps 31*c* and 31*d*, the xenon lamps 31*c* and 31*d* are switched on. Then, when the Area 5 part reaches Fixing Point 3 through the part below the xenon lamps 31*e* and 31*f*, the xenon lamps 31*e* and 31*f* are switched on. Thus, heating processing is performed on the Area 5 part with the light irradiated from the six xenon lamps 31*a* to 31*f*.

The four xenon lamps 31*a* to 31*d* are switched on in fixing processing for the area having "1" or "2" as the value of the amount-of-heat level. In other words, on the amount-of-heat determination table 42 shown in FIG. 4, the lamp control signals 1 to 3 having the signal waveforms shown in FIG. 6B are supplied to the fixing unit 30 for Areas 2 to 4 and Areas 6 to 9. Thus, as shown in FIG. 6B, when the Area 2 part reaches Fixing Point 1, the xenon lamps 31*a* and 31*b* are switched on. Then, when the Area 2 part reaches Fixing Point 2, the xenon lamps 31*c* and 31*d* are switched on. However, when the Area 2 part reaches Fixing Point 3, the xenon lamps 31*e* and 31*f* are switched off. Thus, heating processing is performed on the Area 2 to 4 parts and Area 6 to 9 parts with the light irradiated from the four xenon lamps 31*a* to 31*d*.

All of the xenon lamps 31*a* to 31*f* are kept off in fixing processing for the area having "0" as the value of the amount-of-heat level. In other words, on the amount-of-heat determination table 42 shown in FIG. 4, the lamp control signals 1 to 3 having the signal value at Low level in all periods, not shown, are supplied to the fixing unit 30 for Areas 1 and 10. Thus, heating processing with the xenon lamps 31*a* to 31*f* passing through the fixing unit 30 is not at all performed on the Area 1 and 10 parts of a sheet.

According to this exemplary embodiment, the color printing apparatus 1 analyzes the image datamap 40, detects the maximum number of stacked toner images of toner images for each area subject to fixing processing and determines the amount of heat (the number of lighted xenon lamps 31*a* to 31*f*) to be applied to each area in fixing based on the maximum number of stacked toner images on each area. Thus, since heating processing can be performed on each area with a proper amount of heat, the waste of the amount of heat required for fixing processing can be saved, and the power consumption can be reduced.

VARIATION EXAMPLES

Figure 7:
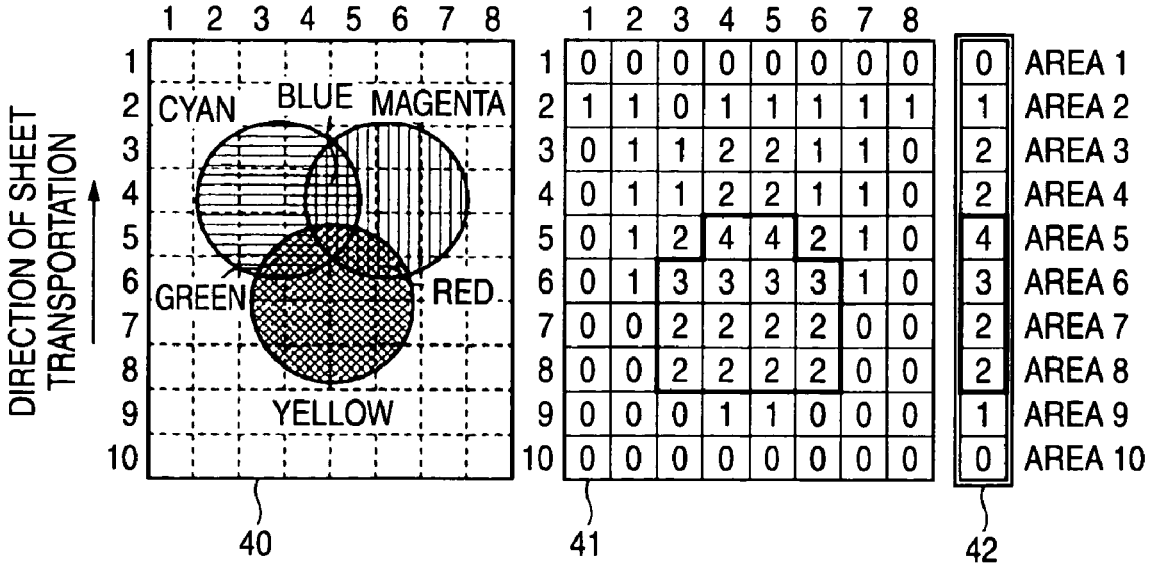
FIG. 7 is a (second) diagram for describing the heat amount determining processing to be performed by the color printing apparatus 1.

[1] For example, in flash-fixing, since the thermal absorption of the yellow toner is lower than those of toners in other colors, a fixing process requires a larger amount of heat. Accordingly, as shown in FIG. 7, the creation of the multi-layer transfer matrix 41 by analyzing the image datamap 40 may include detecting the maximum number of stacked toner images within each square, detecting the color or colors of the toner image or images within the square, and adding "1" to the value of the detected maximum number of stacked toner images for the square including the yellow toner image. On the multi-layer transfer matrix 41 and amount-of-heat determination table 42 shown in FIG. 7, the parts having changes in values from the multi-layer transfer matrix 41 and amount-of-heat determination table 42 shown in FIG. 4 are enclosed by thick lines. The image datamap 40 shown in FIG. 7 is the same as the image datamap 40 shown in FIG. 4. According to the exemplary embodiment above, the amount of heat does not change finally without changing the number of lighted xenon lamps 31*a* to 31*f* when the value of the amount-of-heat level is changed from "1" to "2" or "3" to "4", for example. Thus, "2" may be added to the detected value of the maximum number of stacked toner images on the square including the yellow toner image.

Figure 8:
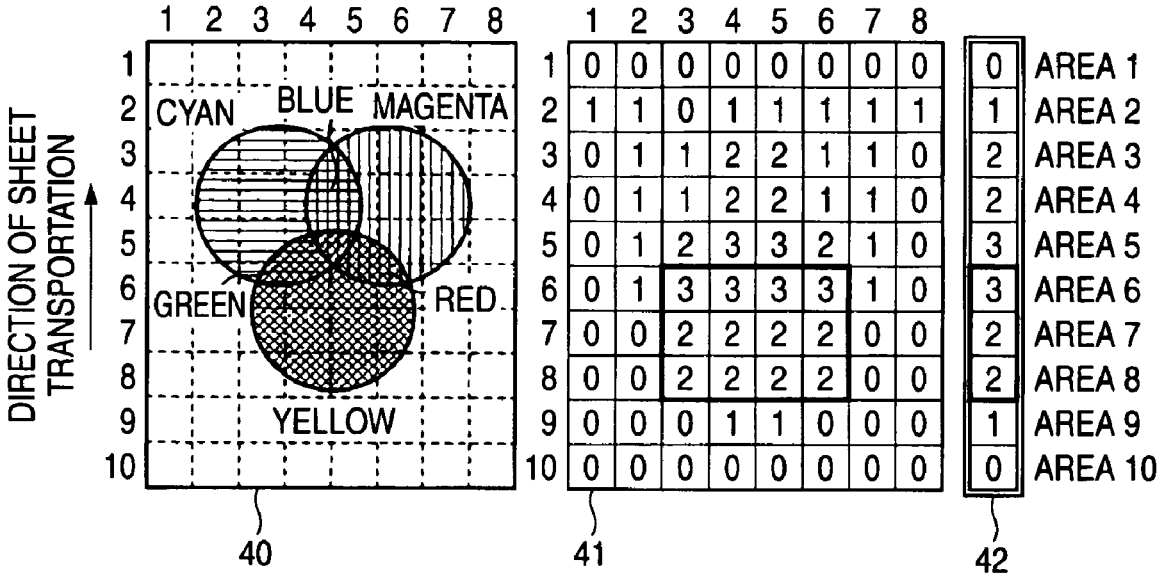
FIG. 8 is a (third) diagram for describing the heat amount determining processing to be performed by the color printing apparatus 1.

A yellow toner does not absorb flash light easily by itself. However, when a yellow toner image is super-imposed on a toner image in another color such as a cyan or magenta toner image, the thermal absorption is largely improved from that of the yellow toner by itself. Accordingly, "1" may be added to the detected value of the maximum number of stacked toner images on the multi-layer transfer matrix 41 only for a square including a yellow toner image without overlapping with toner images in other colors, as shown in FIG. 8. Like FIG. 7, parts having a change in value from the multi-layer transfer matrix 41 and amount-of-heat determination table 42 shown in FIG. 4 are enclosed by the thick line also in FIG. 7. Apparently, as described above, not "1" but "2" may be added to the detected value of the maximum number of stacked toner images.

The amount of heat to be applied in fixing may be increased by a predetermined amount for an area including a yellow toner image or an area including a yellow toner image not overlapping with a toner image in another color among areas defined for fixing processing.

[2] The determination of the amount of heat for each area subject to fixing processing may include the determination of the amount of heat further in consideration of the thermal absorption of a used toner. In other words, when a toner having low thermal absorption is used, the amount of heat is corrected to increase with respect to the case when a toner having standard thermal absorption is used. On the other hand, when a toner having high thermal absorption is used, the amount of heat is corrected to decrease with respect to the case when a toner having standard thermal absorption is used. Notably, as described above, the thermal absorption of a toner depends on the color. The amount of heat may be determined further in consideration of the density of the toner.

[3] According to the exemplary embodiment above, when the amounts of heat to be applied to a sheet largely differ between adjacent areas, for example, when the value of the amount-of-heat level of Area 1 is "0" while the amount-of-heat level of Area 2 is "4", a problem may occur that the sheet may be undulated by a rapid change in amount of heat. Accordingly, when the amounts of heat to be applied to adjacent areas in fixing processing differ by a certain amount or larger, the amount of heat of the area subject to a smaller amount of heat may be increased such that the certain amount of difference or larger cannot occur in the amount of heat to be applied in fixing between adjacent areas. For example, according to the exemplary embodiment above, values of the amount-of-heat levels of adjacent areas, such as Area 1 and Area 2 or Area 2 and Area 3, are compared on the amount-of-heat determination table 42 shown in FIG. 4. In this case, if the difference in the amount-of-heat level of adjacent areas is "3" or higher, the value of the amount-of-heat level may be increased to obtain the difference equal to "2" or lower for the area having a lower value in the amount-of-heat level.

Figure 9A:
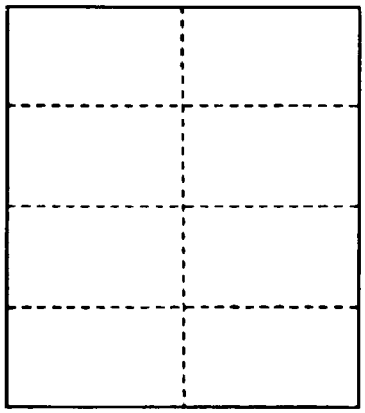
FIGS. 9A and 9B are diagrams showing variation examples of the area subject to fixing processing.
Figure 9B:
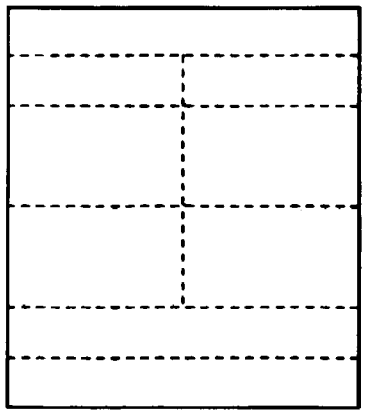

[4] According to the exemplary embodiment above, the amount of heat for each area subject to fixing processing is determined by analyzing color image data input from the input section. However, the amount of heat for each area subject to fixing processing may be determined by imaging the image (actually transferred image) of the toner images in colors multi-layer-transferred on a sheet by the image forming units 20Y, 20M, 20C and 20K by an imaging unit such as a CCD camera before the fixing unit 30 and analyzing the imaged image. Furthermore, according to the exemplary embodiment, the maximum number of stacked toner images is detected for each square on the image datamap 40 shown in FIG. 4. However, the maximum number of stacked toner images may be determined for each row, that is, for each area subject to fixing processing. The area subject to fixing processing may be arranged as shown in FIG. 9A and 9B, for example.

[5] Having described the color printing apparatus 1 that performs full-color printing by using toners in four colors of Y, M, C and K according to the exemplary embodiment above, a color printing apparatus using toners in three colors of Y, M and C may be used. The invention is applicable to a color copier and a color facsimile apparatus, for example. In this case, the input section that inputs color image data may be a color image scanner or may be a recording medium drive that reads color image data from a recording medium such as a memory card and a DVD. Having described the amount of heat to be applied to each area is changed by changing the number of lighted xenon lamps 31*a* to 31*f* according to this exemplary embodiment, the amount of light emitted by the xenon lamps 31*a* to 31*f* may be changed to change the amount of heat to be applied to each area without changing the number of lighted lamps. An LED array may be used instead of the xenon lamps 31*a* to 31*f*, and an image may be printed on an OHP sheet instead of paper.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus that performs fixing processing on a sheet having a transferred toner image in smaller area units than the size of the sheet, the apparatus comprising:

an input unit that inputs color image data;

an image forming unit that performs color separation on color image data input by the input unit and forms a toner image in each of at least one predetermined color;

a transfer unit that transfers the toner image in each color formed by the image forming unit over a sheet;

a detecting unit that detects, for each of the areas, the maximum number of stacked toner images transferred within the area of the sheet having a transferred toner image in the each of the at least one predetermined color by the transfer unit;

a determining unit that determines, for each of the areas, the amount of heat to be applied to the applicable area based on the maximum number of stacked toner images of the area detected by the detecting unit; and a fixing unit that, on each of the areas on the sheet after the transfer processing by the transfer unit, applies the amount of heat determined by the determining unit as the amount of heat to be applied to the area and fixes a transferred toner image in each color.

2. The image forming apparatus according to claim 1, wherein the detecting unit detects the maximum number of stacked toner images transferred within the area and the colors of the transferred images for the area on the sheet having transferred toner images in colors by the transfer unit; and the determining unit determines, for the area, the amount of heat to be applied to the area based on the maximum number of stacked toner images on the area, which is detected by the detecting unit, and the color of the toner images transferred within the area, which is detected by the detecting unit.

3. The image forming apparatus according to claim 2, wherein the determining unit increases the amount of heat to be applied to the area by a predetermined amount for the area having a transferred toner image in a specific color, which does not overlap with a toner image in another color.

4. The image forming apparatus according to claim 1, wherein the determining unit determines, for the area, the amount of heat to be applied to the area based on the maximum number of stacked toner images on the area, which is detected by the detecting unit, and the thermal absorption property of the toner transferred within the area.

5. The image forming apparatus according to claim 1, further comprising:

a comparing unit that compares the amounts of heat of adjacent areas with respect to the amount of heat for areas determined by the determining unit; and an amount-of-heat correcting unit that, when the difference in amount of heat between the adjacent areas is equal to or higher than a predetermined amount as a result of the comparison by the comparing unit, increases the amount of heat to be applied to the area subject to the lower amount of heat such that the difference in amount of heat between the adjacent areas can be lower than the predetermined amount.

6. The image forming apparatus according to claim 1, wherein the detecting unit detects the maximum number of stacked toner images of each of the areas on a sheet having transferred toner images in colors by the transfer unit by analyzing color image data input by the input unit.

7. The image forming apparatus according to claim 1, further comprising an imaging unit that images an image of toner images in colors transferred on a sheet by the transfer unit, wherein the detecting unit detects the maximum number of stacked toner images of each of the areas on a sheet having transferred toner images in colors by the transfer unit by analyzing the image imaged by the imaging unit.

8. An image forming method using an image forming apparatus that performs fixing processing on a sheet having a transferred toner image in smaller area units than the size of the sheet, the image forming method comprising:

forming a plurality of toner images corresponding to predetermined colors on a sheet;

detecting, for each of the areas, the maximum number of stacked toner images transferred within the area of the sheet having a transferred toner image in each of at least one color;

determining, for each of the areas, the amount of heat to be applied to the applicable area based on the maximum number of stacked toner images of the area detected; and applying, on each of the areas on the sheet on which the plurality of the toner images are formed, the determined amount of heat to fix a transferred toner image in the each of the at least one color.

* * * * *